US010050391B2

(12) United States Patent
Herbrechtsmeier

(10) Patent No.: US 10,050,391 B2
(45) Date of Patent: Aug. 14, 2018

(54) HOLDING FRAME FOR A PLUG CONNECTOR

(71) Applicant: HARTING Electric GmbH & Co. KG, Espelkamp (DE)

(72) Inventor: Heiko Herbrechtsmeier, Buende (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/030,860

(22) PCT Filed: Dec. 11, 2014

(86) PCT No.: PCT/DE2014/100438

§ 371 (c)(1),
(2) Date: Apr. 20, 2016

(87) PCT Pub. No.: WO2015/085994

PCT Pub. Date: Jun. 18, 2015

(65) Prior Publication Data

US 2016/0276786 A1 Sep. 22, 2016

(30) Foreign Application Priority Data

Dec. 12, 2013 (DE) ..... 10 2013 113 973
Dec. 12, 2013 (DE) ..... 10 2013 113 974

(51) Int. Cl.
*H01R 13/60* (2006.01)
*H01R 13/73* (2006.01)
(Continued)

(52) U.S. Cl.
CPC ..... *H01R 13/73* (2013.01); *H01R 9/16* (2013.01); *H01R 13/506* (2013.01); *H01R 13/514* (2013.01)

(58) Field of Classification Search
CPC ..... H01R 13/73; H01R 13/514; H01R 12/73; H01R 13/02; H01R 9/091; H01R 13/506; H01R 9/16
(Continued)

(56) References Cited

U.S. PATENT DOCUMENTS 3,165,606 A * 1/1965 Cooper ..... H01H 3/141 200/86 R
3,974,552 A * 8/1976 Minogue ..... G09F 7/14 156/461
(Continued)

FOREIGN PATENT DOCUMENTS

DE 2736079 2/1979 ..... H01R 13/518
DE 8533584 6/1986 ..... H01R 13/658
(Continued)

OTHER PUBLICATIONS

German Office Action issued in application No. 10 2013 113 973.6, dated Nov. 21, 2014 (5 pgs).
(Continued)

*Primary Examiner* — Jean F Duverne
(74) *Attorney, Agent, or Firm* — Hayes Soloway P.C.

(57) ABSTRACT

Provided a holding frame for a plug connector with a good heat resistance and a high mechanical robustness and to enable a protective earthing during installation in a metallic plug connector housing, yet at the same time guarantee a convenient serviceability, in particular during replacement of individual modules. To achieve this aim, the manufacture of the holding frame at least partially from resilient sheet metal is proposed. Due to the resilient properties of the sheet metal, it is possible to insert or remove modules with very little effort. The sheet metal can be bent and/or folded in certain regions and can thereby be strengthened in targeted
(Continued)

regions, in order to achieve a particularly advantageous combination of holding and actuating forces.

36 Claims, 11 Drawing Sheets

(51) Int. Cl.
*H01R 13/506* (2006.01)
*H01R 13/514* (2006.01)
*H01R 9/16* (2006.01)

(58) Field of Classification Search
USPC ..... 439/540.1
See application file for complete search history.

(56) References Cited

U.S. PATENT DOCUMENTS

| | | | | |
|---|---|---|---|---|
| 4,097,632 | A * | 6/1978 | Minogue | G09F 7/14 156/153 |
| 4,616,288 | A | 10/1986 | Scholtholt et al. | 361/119 |
| 4,682,839 | A | 7/1987 | Bryce | 439/598 |
| 6,004,162 | A | 12/1999 | Harting et al. | 439/701 |
| 6,977,337 | B1 * | 12/2005 | Satullo | H05K 7/20436 174/559 |
| 7,316,591 | B2 | 1/2008 | Ferderer | 439/701 |
| 2010/0117395 | A1 * | 5/2010 | Wieczorek | B60J 3/0208 296/97.5 |
| 2013/0217268 | A1 | 8/2013 | Duan et al. | 439/660 |
| 2013/0295784 | A1 * | 11/2013 | Hasegawa | H01R 9/091 439/55 |
| 2014/0256195 | A1 * | 9/2014 | Obikane | H01R 13/02 439/700 |
| 2014/0342592 | A1 * | 11/2014 | Ashibu | H01R 12/79 439/267 |
| 2015/0207256 | A1 * | 7/2015 | Wu | H01R 12/73 439/660 |

FOREIGN PATENT DOCUMENTS

| | | | |
|---|---|---|---|
| DE | 29508095 | 7/1995 | H01R 13/514 |
| DE | 202013103611 | 9/2013 | H01R 13/514 |
| EP | 0860906 | 8/1998 | H01R 13/514 |
| EP | 1801927 | 6/2007 | H01R 13/518 |
| EP | 2228871 | 9/2010 | H01R 13/658 |
| EP | 2581991 | 4/2013 | H01R 13/506 |
| GB | 1542971 | 3/1979 | H01R 13/46 |
| KR | 1020120099271 | 9/2012 | H01R 13/518 |
| RU | 2172048 | 8/2001 | H01R 9/053 |
| RU | 2490764 | 8/2013 | H01R 13/11 |
| SU | 1308207 | 4/1987 | H01R 13/11 |
| WO | WO2008121092 | 10/2008 | |
| WO | WO2011069522 | 6/2011 | H01R 13/518 |

OTHER PUBLICATIONS

German Office Action issued in application No. 10 2013 113 974.4, dated Nov. 21, 2014 (5 pgs).
International Search Report and Written Opinion issued in application No. PCT/DE2014/100438, dated Jun. 1, 2015 (15 pgs).
International Preliminary Report on Patentability issued in application No. PCT/DE2014/100438, dated Jun. 23, 2016 (7 pgs).
Korean Office Action (w/translation) issued in application No. 10-2016-7018664, dated May 1, 2017 (20 pgs).
German Office Action (w/machine translation) issued in application No. 14 830 505.5, dated Jan. 24, 2018 (8 pgs).
Russian Search Report (w/machine translation) issued in application No. 2016125447/07, dated Nov. 20, 2017 (4 pgs).

* cited by examiner

HOLDING FRAME FOR A PLUG CONNECTOR

BACKGROUND OF THE INVENTION

The invention relates to a holding frame for a plug connector and to a method for producing a holding frame and to a method for producing a metal holding frame.

Holding frames of this type are required in order to receive a plurality of modules of the same kind and/or also a plurality of different modules. By way of example, these modules can be insulating bodies, which are provided as contact carriers for electronic and electrical and possibly also for optical and/or pneumatic contacts. It is particularly important that the holding frame of the type in question is manufactured from a metal material, because this is necessary for the production of a regulation-compliant protective earthing according to plug connector standard EN61984, for example for insertion of the holding frame loaded with modules into a metal plug connector housing.

DISCUSSION OF THE PRIOR ART

A holding frame for supporting plug connector modules and for installation in plug connector housings and/or for screwing to wall surfaces is known from document EP 0 860 906 B1, wherein the plug connector modules are inserted into the holding frame and supporting means on the plug connector modules cooperate with recesses provided on opposite wall parts (side faces) of the holding frame, wherein the recesses are formed as openings, which are closed on all sides, in the side faces of the holding frame, wherein the holding frame consists of two halves connected to one another in a hinged manner, wherein the holding frame separates transversely to the side faces of the frame, and wherein hinges are arranged in the fastening ends of the holding frame in such a way that when the holding frame is screwed onto a fastening surface the frame parts are oriented in such a way that the side faces of the holding frame are oriented at right angles to the fastening surface, and the plug connector modules are connected to the holding frame in an interlocking manner by means of the supporting means. Holding frames of this type are usually manufactured in practice in a diecasting method, in particular in a zinc diecasting method.

Document EP 2 581 991 A1 discloses a holding frame for plug connector modules which has two frame halves, which can be latched to one another by linear displacement of one frame half relative to the other frame half in a direction of displacement, wherein detent means corresponding to one another are arranged on each of the frame halves and in the event of linear displacement latch the two frame halves to one another in two different latch positions, in which the frame halves are spaced apart from one another at a different distance.

It has been found in practice however that holding frames of this type require complex handling during assembly. By way of example, holding frames of this type must be unscrewed and/or unlatched from the plug connector as soon as even just a single module is to be replaced. Here, the other modules, the removal of which was not even desired, might also fall out of the holding frame and then have to be inserted again before the frame halves are screwed together and/or latched. Lastly, all modules must be disposed simultaneously in their intended positions already before the frame halves are joined together so as to be ultimately fixed in the holding frame when the frame halves are joined together, which complicates the assembly.

Document EP 1 801 927 B1 discloses a holding frame that consists of a one-piece plastics injection-molded part. The holding frame is formed as a peripheral collar and has, on its plugging side, a plurality of wall segments separated by slots. Each two opposed wall segments form an insertion region for a plug module, wherein the wall segments have window-like openings, which serve to receive protrusions integrally molded on the narrow sides of the modules. A guide groove is also provided in each of the wall segments. The guide groove is formed above the openings by means of an outwardly offset window web, which on the inner side has an insertion bevel. In addition, the plug modules have detent arms, which are integrally molded on the narrow sides in a manner acting in the direction of the cable connections, and which latch beneath the lateral collar wall, such that two independent detent means fix the plug connector modules in the holding frame.

In the case of this prior art it is disadvantageous on the one hand that the holding frame is a holding frame formed from plastic, which holding frame is not suitable for protective earthing, for example by means of a PE contact, i.e. for example is not suitable for installation in metal plug connector housings. However, the use of metal plug connector housings presupposes a protective earthing of this type and is necessary in many cases, for example on account of the mechanical robustness thereof, temperature resistance thereof, and their electrically shielding properties, and is therefore desired by the customer. It has also been found that the production of plastics holding frames formed in this way by means of injection molding is at the least problematic and can be implemented only with a high level of effort. Lastly, the heat resistance of a holding frame of this type also is not always sufficient for particular applications, for example in the vicinity of a blast furnace. Lastly, the plastics material and the shape, in particular the strength of the holding frame at the relevant points, are determined primarily by the requirements placed on flexibility and not by those of temperature resistance.

SUMMARY OF THE INVENTION

The problem addressed by the invention is that of specifying a design and a production method for a holding frame, which on the one hand has a good heat resistance and a high mechanical robustness and in particular enables an appropriate protective earthing, in particular a PE (protection earth) protective earthing, even in the case of installation in a metal plug connector housing, and on the other hand also ensures comfortable handling, in particular when replacing individual modules.

A holding frame of this type can be used in the field of heavy industrial plug connectors and consists at least in part of a metal material, specifically sheet metal, which thus enables a protective earthing, in particular a PE protective earthing, and at the same time makes it possible, on account of the resilient properties of the sheet metal, to insert or to remove modules individually with only very little effort. The use of sheet metal as material also ensures a high temperature resistance and furthermore also a particularly high mechanical robustness of the holding frame.

A resilient sheet metal is to be understood here to mean a sheet metal that has resilient properties, such as a reversible deformability, in particular with application of a corresponding restoring force, i.e. for example a sheet metal that is manufactured from spring steel or a comparable material.

One advantage of the invention therefore lies in the fact that the modules can be individually inserted into the holding frame and removed therefrom again with only very little effort.

In particular, it is particularly advantageous when the modules have a cable connection side, which is intended to be connected to a cable, for example by screwing, crimping, soldering, or the like, and that the modules are inserted, into the holding frame from the direction of their cable connection side, because they can thus be completely removed, again from the holding frame in the direction of their cable connection side, even in a wired state. This is also true in particular in the installed state, i.e. also when the holding frame is already installed in a plug connector housing, for example a flange mounting housing. A further advantage thus also lies in the fact that the cable can be pre-assembled with the modules and can be inserted into a holding frame only later, independently of the pre-assembly process. The holding frame can also be replaced in this way, without having to separate the modules from the cable for this purpose, for example when the holding frame is worn and/or damaged.

A further advantage of the invention lies in the fact that the holding frame, for electrical safety, enables a protective earthing, in particular a PE protective earthing of a metal plug connector housing in which the holding frame is inserted. This furthermore also ensures, as an additional advantage, a shielding of the signals transmitted through the plug connector. This shielding may be a protection against interfering fields from outside. However, the shielding may also be a shielding for avoiding or reducing emitted interference, i.e. for protecting the environment against interfering fields of the plug connector. In other words, not only are the signals transmitted through the modules protected against external interfering fields, but there is also provided a protection of the surroundings from interference produced by a flow of current running through the modules.

A particularly great additional advantage lies in the fact that the holding frame on the one hand is particularly heat-resistant and on the other hand still has a sufficiently high elasticity at the necessary points to insert the modules individually and with little effort into the module frame and to remove these again. Here, it is particularly advantageous when the entire holding frame (or at least the functional part of the holding frame for receiving and fixing the modules) consists of resilient sheet metal, since it is thus much more resistant to heat, with at least just as much elasticity, than a plastics frame which is otherwise functionally comparable from a mechanical viewpoint. Relevant modules can be designed in an accordingly compact manner, such that they can still be fabricated from plastic and are nevertheless relatively resistant to heat.

Here, it is particularly advantageous that both the material and the design of these modules need to have only low elasticity, because the holding frame already consists of a resilient sheet metal and is therefore able for example to hold the modules at a continuous basic tension, even over a relatively long period of time, without fundamentally changing, i.e. for example without deforming irreversibly to such an extent, and in particular without "creeping" under a continuous mechanical and thermal load to such an extent that the holding force of said holding frame with respect to the modules and/or for example also the contact pressure against a mating plug and therefore the optimal function of the plug connector are compromised. In other words, the modules can be resiliently clamped in the holding frame without the modules themselves requiring elastic parts and/or material properties for this purpose.

It is therefore particularly advantageous when the holding frame is produced at least in part from resilient sheet metal, i.e. at least in part from one or more resilient sheet metal parts. In particular, the holding frame can be produced by means of punching and bending, such that the one or more sheet metal parts is/are (a) punched and bent part(s). This advantageously enables production using tools that are conventional for punching and bending technology, such that no special tools are necessary for the production of a holding frame of this type. When the holding frame consists of a number of punched and bent parts, these punched and bent parts can then consist of the same sheet metal and therefore have the same material properties, in particular the same elasticity as one another. However, they can also be punched out from different sheet metals and can have different material properties, in particular different strengths and/or elasticities.

It is particularly advantageous when the holding frame has a plurality of different regions, which have a different elasticity from one another, because a higher section modulus can then be applied purposefully in the region of the highest bending load. The first region with higher section modulus may thus be a basic portion. The second region with lower section modulus may be a deformation portion.

This can be implemented both with a holding frame consisting of a single sheet metal part and with a holding frame consisting of a plurality of sheet metal parts, wherein the sheet metal parts can have the same or different material properties, in particular the same or different elasticities.

By way of example, a holding frame can consist exclusively of sheet metal parts that consist of the same material and in addition have the same strength, i.e. for example are punched out from the same punching sheet. For this purpose, a first of these regions, i.e. for example the basic portion, can consist of a peripheral basic frame. The basic frame can be substantially rectangular in cross section, i.e. has two opposite end parts parallel to one another and, at right angles thereto, two opposite side parts parallel to one another, wherein the end parts are shorter than the side parts. End and side parts can also be of equal length in the particular case of a square cross section.

As a result of this closed form, the geometry of the basic frame and therefore also the geometry of the entire holding frame already contributes to providing this first region, specifically the basic frame, with a lower elasticity and therefore a greater strength than a second region, which for example consists of a cheek region having freely protruding resilient tabs, which are separated from one another by slots. This is true in particular when the holding frame is fixedly mounted in a plug connector housing, for example is screwed at four screw bores into the plug connector housing. In addition, the sheet metal of the holding frame can be purposefully strengthened in the first region, specifically the basic frame, at least at some points, in particular at the side parts and possibly also at the end faces, in that different layers of the same sheet metal part come to lie there on one another in a planar manner, for example by folding or by further layers of at least one other sheet metal part by means of the joining and fastening thereof, i.e. by what is known as a join connection. In the case of the join connection, referred to as a "join" for short, these sheet metal parts are fastened to one another at one or more suitable points for example by adhesive bonding, welding, soldering, riveting or any other suitable fastening method.

The appropriate modules can be substantially cuboidal and each have a detent lug on two mutually opposed longitudinal sides, which lugs likewise can be substantially cuboidal. Each of the resilient tabs of the holding frame advantageously has a detent window, which can be substantially rectangular, and which is intended to receive a detent lug of this type, preferably in an interlocking manner.

The two detent lugs of a module can differ from one another, for example in terms of their shape and/or their size, in particular by their length, and the tabs on both sides of the holding frame can have corresponding (for example rectangular) windows, which likewise differ from one another and which each fit one of the detent lugs in terms of size and/or shape. This has the advantage that the orientation of each module in the holding frame is fixed as a result. In other words, the detent windows and the detent lugs can be used on the basis of their shape and/or size as coding means for orientation of the modules in the holding frame.

The tabs of the holding frame are advantageously bent away slightly from the holding frame in a freely protruding end region, which simplifies the insertion of the modules. A module can then be inserted into the holding frame in a particularly user-friendly manner. For this purpose, a module specifically is firstly inserted between two tabs of a holding frame and then slides via its two longitudinal sides and in particular via the detent lugs integrally molded thereon along the end regions of the tab bent away from one another. The two tabs thus bend temporarily further away from one another until the detent lugs in question are received by the associated detent window of the relevant tab and therefore latch therein, in particular audibly. As the detent lugs are received in the detent windows, the tabs preferably spring back into their starting position. The modules can thus latch individually in the holding frame, preferably audibly.

At the same time, the inserted module is held in the stable basic frame with comparatively high force, in particular when the holding frame is fixedly mounted in a plug connector housing, for example is screwed into the plug connector housing at four screw bores. In order to unlatch the modules again, merely the two mutually opposed elastic tabs have to be bent away from one another again. The relevant module can then be removed individually from the holding frame, whereas the other modules are still latched. Furthermore, a high holding force alongside a comparatively low' actuation force is ensured in this way, in particular by the different elasticity of the various regions, which is particularly advantageous for the handling.

Handling is facilitated further when the latching of the detent lugs in the detent windows generates a noise, because the correct positioning of the module is thus also signaled acoustically to the user.

It is also particularly advantageous that the modules are held with sufficient holding force in the holding frame already by the above-specified construction, and accordingly, besides their detent lugs, require no further detent means, for example detent arms, which facilitates their design and therefore their production effort considerably and at the same time ensures a compact design and therefore also a high heat resistance of the modules and therefore of the entire plug connector.

It is particularly advantageous when producing the holding frame that the sheet metal part or the sheet metal parts is/are formed in such a way, in particular punched and bent and/or joined together, that some of their regions come to lie on one another and thus strengthen one another in terms of their spring force and possibly in terms of their holding force for the intended functions thereof.

The sheet metal can thus be strengthened at some points, for example by folding a sheet metal part and/or by joining together a plurality of individual sheet metal parts, and for example can be doubled, trebled, quadrupled, etc. in strength, i.e. can be increased n-fold in terms of strength. The manufacturing advantages of the punching and bending method can thus be combined with selective influencing of the elasticity, which otherwise is difficult to provide, in particular when the same punching sheet is used, which originally has a constant strength. By folding and/or joining, a resilient sheet metal can thus be used as a particularly well-suited material for the holding frame, and the elasticity of individual regions of the holding frame can be purposefully influenced in the above-described way, even with use of a single punching sheet, which facilitates the manufacture.

In an advantageous embodiment the side parts of the basic frame can be strengthened, for example. For this purpose, a cheek region can be provided additionally to each side face in a manner bordering thereon, which cheek region has a strengthening region and tabs protruding therebeyond, adjoining said region or overlapping therewith. The cheek region can be bent via its strengthening region in a bending process through 180° and thus folded over the side face and can thus protect this side face against externally acting forces. Subsequently, the cheek region can have slots over its entire surface or in regions, which divide said cheek region along the side parts at equidistant intervals, wherein the width of these intervals advantageously corresponds to the width of the modules. The slots can reach as far as the strengthening region. The tabs protruding in a direction beyond the basic frame are formed by the slots. In the opposite direction the side parts of the basic frame strengthened in this way can likewise protrude via their respective bending edges beyond the end faces. The side parts thus have a greater width than the end faces. This has the advantage that the modules are held in the holding frame over a greater area and with an increased holding force in particular via a corresponding lever effect.

The folded cheek region thus protrudes via its freely protruding end beyond the basic frame in an unstrengthened manner and thus forms the substantially more elastic second region, which for example can be considered as a deformation portion. On account of its slots, this is achieved in particular by the individual, freely protruding, resilient tabs, which already have a comparatively high elasticity on account of their shape. The tabs are also, in contrast to the basic frame, preferably formed from only a single, unstrengthened sheet metal, i.e. are not strengthened by a second sheet metal, and therefore have only the plain strength of this single sheet metal and also therefore a greater elasticity than the first region. In addition, the tabs in the region of their slots advantageously are not fastened themselves to the side face, but are only connected to the side face via the bending edge of the strengthening region. This has the advantage that the tabs have a high elasticity in respect of outwardly acting forces, whereas the side parts in the region of the basic frame oppose outwardly acting forces with high stability, since they are strengthened by the strengthening regions. Since the tabs are connected to the side face only by the reinforcement region via the common bending edge, they spring outwardly over their entire length in an unstrengthened manner, whereas the side faces are strengthened in respect of outwardly acting forces by the strengthening regions, and therefore in particular also by a corresponding region of overlap of the tabs.

In an advantageous embodiment only a single sheet metal part is used to produce the holding frame. Each end face for example can then be strengthened in that, as the sheet metal is punched, a strengthening face is additionally punched out in particular in a mirror image with respect to each end face and bordering thereon, which strengthening face is then bent through 180° and is thus folded over the end face in order to strengthen this and thus additionally stabilize the basic frame. This strengthening area can also be bent at right angles at an end then protruding beyond the end face, such that a freely protruding flange is produced at the end of the end face, which flange can have screw bores for fastening, for example in a plug connector. For stabilization, this flange can also be strengthened in a similar manner, specifically by folding or joining.

In an alternative advantageous embodiment the flange can directly adjoin the unstrengthened end face and can be bent at right angles therefrom. The end face is then net strengthened, however both material and a corresponding process step in the production are saved. Furthermore, irrespective of this, the side faces can nevertheless be strengthened, which ultimately is of primary importance in order to hold the modules.

A large number of further embodiments are also conceivable, in which the holding frame is formed from a plurality of like and/or different resilient sheet metal parts, which for example are fastened to one another by gluing, welding, soldering, screwing and/or riveting. In particular, these sheet metal parts can be produced by means of punching and bending, such that the sheet metal parts are punched and bent parts. The holding frame can preferably be formed from two sheet metal parts which are substantially U-shaped in the cross section of the basic frame, and which thus each have two end faces, specifically a first and a second end face. The two sheet metal parts are then slid one inside the other with an offset during the production of the holding frame, in particular offset by a sheet metal thickness, in such a way that their first and second end faces come to lie on one another and are fastened to one another for example by gluing, welding, soldering, screwing and/or riveting. In particular, the first end face of one of the sheet metal parts comes to lie on the second end face of the other sheet metal part and is then fastened thereto. This embodiment, in addition to the resultant strengthening of the sheet metal in the region at the end faces, additionally has the further advantage that the holding frame in the region of its basic frame is in this way closed over a large area and therefore in a very stable manner.

By screwing the holding frame at the screw bores in its flange, for example in or on a plug connector housing, the basic frame is furthermore considerably stabilized.

A flange, possibly having screw bores, similarly to that described above, can then again be bent at right angles at an edge of the first end face thus coming to lie externally. In a further advantageous embodiment the second end faces can then additionally also have a strengthening flange, which when joined together comes to lie on the flange of the first end face and for strengthening is fastened thereto, for example by gluing, welding, soldering, screwing and/or riveting. The flange of the holding frame is thus particularly stable.

In an advantageous embodiment the two sheet metal parts are identical, i.e. only sheet metal parts of one type must be produced in spite of the two-part embodiment of the holding frame, which further reduces the production effort.

In another preferred embodiment the two sheet metal parts differ at least by the size and/or the shape of their detent windows. This has the advantage that the orientation of each module, which accordingly also has two different detent lugs, is thus fixed. In other words, the detent windows and the detent lugs thus serve on account of their shape as coding means for orientation of the modules.

In a further preferred embodiment the holding frame can consist of more than two sheet metal, parts, in particular punched and bent parts, which for example are fastened to one another by gluing, welding, soldering, screwing and/or riveting.

BRIEF DESCRIPTION OF THE DRAWINGS

An exemplary embodiment of the invention is illustrated in the drawing and will be explained in greater detail hereinafter. In the drawing.

DETAILED DESCRIPTION OF THE INVENTION

Figure 1A:
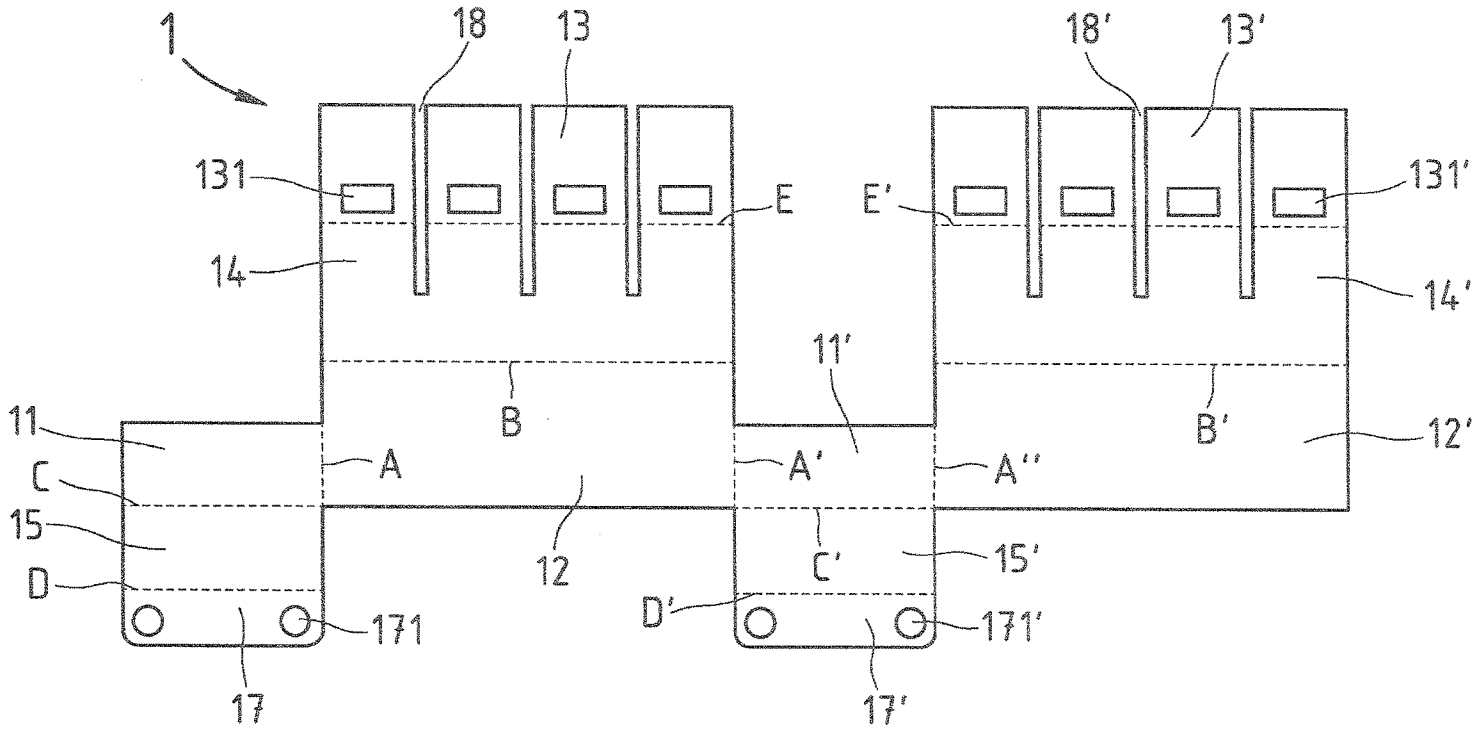
FIG. 1*a* shows a first sheet metal part in the unbent state.

FIG. 1*a* shows, in a first embodiment, a first, one-piece sheet metal part 1 in an unbent state.

The first sheet metal part 1 has the following:

- two end faces 11, 11', specifically a first end face 11 and a second end face 11';
- two side faces 12, 12', specifically a first side face 12 and a second side face 12', wherein the side faces 12, 12' are both wider and longer than the end faces 11, 11' and therefore protrude beyond the adjoining end faces 11, 11' in the direction of the first bending lines A, A', A";
- eight freely protruding tabs 13, 13', which each have a detent window 131, 131', wherein the tabs 13, 13' are separated from one another by slots 18, 18', wherein the number of tabs 13, 13' and the number of slots 18, 18' corresponding thereto are selected by way of example, and wherein the detent window 131 in four of the tabs 13 is wider than the detent window 131' in the other four slots 13';
- two strengthening regions 14, 14', which border the end faces 12, 12' at delimitation, lines E, E' on the one hand and at second bending lines B, 13' on the other hand;
- two strengthening faces 15, 15' bordering the end faces 11, 11' at third bending lines C, C'; and
- flanges 17, 17', which border the strengthening flanges 15, 15' at a fourth bending line D, D' and have screw bores 171, 171'.

The first sheet metal part 1 is folded through 180° at the second and third bending lines B, B', C, C' illustrated by dashed lines. Each of the two strengthening regions 14, 14' thus comes to lie on one of the side faces 12, 12' respectively, and each of the two strengthening faces 15, 15' comes to lie on one of the end faces 11, 11' respectively, in order to strengthen the side faces 12, 12' and the end faces 11, 11' accordingly. The delimitation lines E, F' illustrated in a dashed manner thus constitute a limit, from which the tabs 13, 13' then protrude beyond the side faces 12, 12'. The strengthening regions 14, 14' are connected here to the associated side faces 12, 12' merely at the common second bending lines B, B', i.e. are not fastened thereto in any other way, i.e. are not adhesively bonded, soldered, welded, riveted, screwed or the like.

The tabs 13, 13' thus have an accordingly high flexibility, since they can be bent over their entire length individually away from the side faces 12, 12', i.e. into the strengthening regions 14, 14'. The length and therefore also the desired resilience of the tabs 13, 13' can thus be set by the length of the slots 18, 18'.

The tabs 13, 13' and the further strengthening regions 14, 14' are referred to jointly in each case as a cheek region, which for the sake of clarity has not been provided with a reference sign. The cheek region is thus divided by the six slots 18, 18' largely into intervals of equal size, whereby the tabs 13, 13' are formed, such that the length of the tabs 13, 13' corresponds to the length of the slots 18, 18'. The term "largely" is to be understood in this context to mean that the slots 18, 18' and therefore also the tabs 13, 13' extend beyond the delimitation lines E, E' into the relevant strengthening regions 14, 14', but preferably end before the second bending lines B, B'. In other words, at least part of the strengthening regions 14, 14' is formed by the tabs 13, 13'. A region of overlap thus exists, which is attributed both to the tabs 13, 13' and to the strengthening regions 14, 14', specifically the region of the tabs 13, 13' lying between the delimitation lines E, E' and the second bending lines B, B'. This region of overlap thus has a dual function, since it serves on the one hand to increase the stability of the basic frame and on the other hand to increase the elasticity of the tabs 13, 13' in respect of outwardly acting forces. This is true in particular when the holding frame is fixedly mounted in a plug connector housing, for example is screwed at its four screw bores 171, 171' into the plug connector housing.

The side faces 12, 12' protrude beyond the end faces 11, 11' also in the folded state via one of their bending edges corresponding to the second bending line B, B'.

At the first and fourth bending lines A, A', A", D, D', likewise illustrated in a dashed manner, the first sheet metal part 1 is bent at right angles. Due to the right-angled bending at the fourth bending lines D, D', the flanges 17, 17' are formed respectively, these having the screw bores 171, 171' for fastening, for example on or in a plug connector housing (not illustrated in the drawing). The right-angled bending of the sheet metal part 1 about the first bending line A, A', A" ensures the closed form of a basic frame, which is thus formed from the end faces 11, 11' and the side faces 12, 12', strengthened by the strengthening faces 15, 15' and the strengthening regions 14, 14', i.e. is thus formed from two end parts and two side parts. This right-angled bending is provided in such a way that the cheek region is arranged outside the basic frame, i.e. on the outer side of the side faces 12, 12' thereof.

In order to fix the closed form of the basic frame, the second side face 12' must lastly be fastened to the first end face 11, for example by adhesive bonding, welding, soldering, screwing, riveting or the like. This is advantageously implemented by positioning a plurality of weld points.

The first end face 11 strengthened by the first strengthening face 15 thus forms the first end part of the basic frame. The second end face 11 strengthened by the second strengthening face 15' furthermore forms the second end part of the basic frame. Together with the two side parts bent at right angles therefrom, said side parts being formed from the two side faces 12, 12', which are strengthened by the relevant strengthening regions 14, 14' respectively, these two end parts form the basic frame.

Figure 1B:
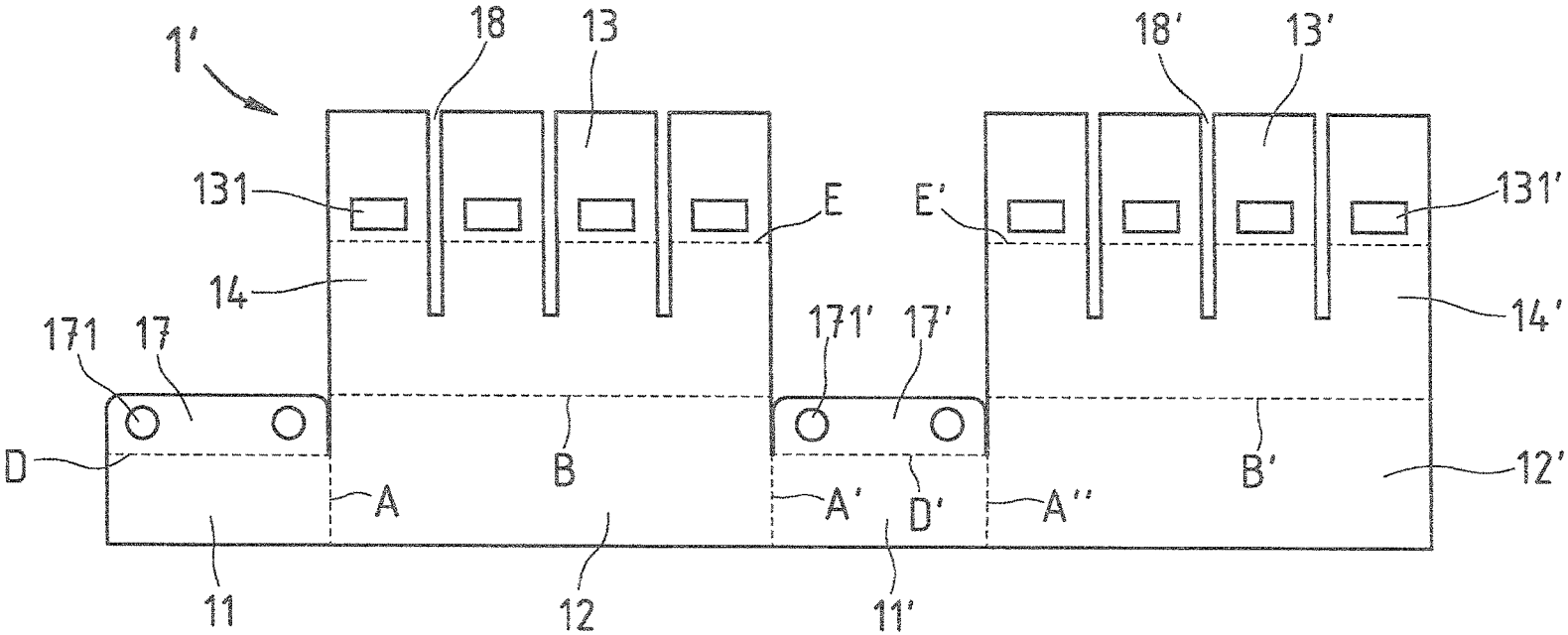
FIG. 1*b* shows a second sheet metal part in the unbent state.

FIG. 1*b* shows a second sheet metal part 1' in an unbent state in a variant of the first embodiment.

The second sheet metal part 1' differs from the first sheet metal part in that it has no strengthening faces 15, 15' and accordingly also no associated third bending lines C, C', whereby the flanges 17, 17' with their screw bores 171, 171' thus border the corresponding end faces 11, 11' via the fourth bending lines D, D'. The second sheet metal part 1' thus has the following:

- the two end faces 11, 11', specifically the first end face 11 and the second end face 11';
- two side faces 12, 12', specifically the first side face 12 and the second side face 12', wherein the side faces 12, 12' are both wider and longer than the end faces 11, 11' and therefore protrude beyond the adjoining end faces 11, 11' in the direction of the first bending lines A, A', A";
- the eight freely protruding tabs 13, 13', which each have a detent window 131, 131', wherein the tabs 13, 13' are separated from one another by slots 18, 18', wherein the number of tabs 13, 13' and the number of slots 18, 18' corresponding thereto are selected by way of example, and wherein the detent window 131 in four of the tabs 13 is wider than the detent window 131' in the other four slots 13';
- the two strengthening regions 14, 14', which border the delimitation lines 8, 8' on the one hand and the second bending lines B, B' on the other hand;
- the flanges 17, 17' already mentioned above, which border the end faces 11, 11' at the bending lines D, D' and have screw bores 171, 171'.

At the second bending lines B, B', illustrated by dashed lines, the second sheet metal part 1' is folded through 180°. Each of the strengthening regions 14, 14' thus comes to lie on one of the side faces 12, 12' respectively, in order to strengthen the side faces 12, 12' accordingly. The dashed lines 8, 8' thus constitute the limit from which the tabs 13, 13' then protrude beyond the side faces 12, 12'. The strengthening regions 14, 14' are connected here to the associated side faces 12, 12' merely at the common bending lines, specifically at the second bending lines B, B', and accordingly are not fastened thereto in any other way, i.e. are not adhesively bonded, soldered, welded, riveted or the like. The tabs 13, 13' thus have a high flexibility accordingly, since they can be bent over their entire length individually away from the side faces 12, 12', i.e. into the strengthening regions 14, 14'. The length and therefore also the desired resilience of the tabs 13, 13' can thus be set by the length of the slots 18, 18', without changing the material.

The tabs 13, 13' and the further strengthening region 14, 14' are designated jointly as a cheek region, which for the sake of clarity is not provided with a reference sign. The cheek region is thus divided largely into equal intervals by the six slots 18, 18', whereby the tabs 13, 13' are formed, such that the length of the tabs 13, 13' corresponds to the length of the slots 18, 18'. The term "largely" is to be understood in this context to mean that the slots 18, 18' and therefore also the tabs 13, 13' extend beyond the delimitation lines E, E' into the strengthening regions 14, 14', but preferably end before the second bending lines B, B'. In other words, at least part of the strengthening regions 14, 14' is formed by the tabs 13, 13'. A region of overlap thus exists, which is attributed both to the tabs 13, 13' and to the strengthening regions 14, 14', specifically the region of the tabs 13, 13' lying between the delimitation lines E, E' and the second bending lines B, B'. This region of overlap thus has a dual function, since it serves on the one hand to increase the stability of the basic frame and on the other hand to increase the elasticity of the tabs 13, 13' in respect of outwardly acting forces. This is true in particular when the holding frame is fixedly mounted in a plug connector housing, for example is screwed at its four screw bores 171, 171' into the plug connector housing.

The side faces 12, 12' protrude beyond the end faces 11, 11' also in the folded state via one of their bending edges corresponding to the second bending line B, B'.

At the first and fourth bending lines A, A', A", D, D', likewise illustrated in a dashed manner, the sheet metal part 1 is bent at right angles. Due to the right-angled bending at the fourth bending lines D, D', the flanges 17, 17' are formed respectively, these having the screw bores 171, 171' for fastening, for example on or in a plug connector housing (not illustrated in the drawing). The right-angled bending of the sheet metal part 1' about the first bending line A, A', A" ensures the closed form of a basic frame, which is thus formed from the end faces 11, 11' and side faces 12, 12', strengthened by the strengthening regions 14, 14'. This right-angled bending is provided in such a way that the cheek region is arranged outside the basic frame, i.e. on the outer side of the side faces 12, 12' thereof.

In order to fix the closed form of the basic frame, the second side face 12' must be fastened to the first end face 11, for example by adhesive bonding, welding, soldering, screwing, riveting or the like. This can be implemented in particular by a plurality of weld points.

Since a holding frame according to the above embodiments can be formed solely from a single, one-piece punched and bent part, the first and second sheet metal parts 1, 1' are particularly well suited for machine manufacturing of the holding frame 4.

The first end face 11, which is unstrengthened, thus forms the first end part of the basic frame in this embodiment. The second end face 11, which is unstrengthened, furthermore forms the second end part of the basic frame. Together with the two side faces 12, 12' bent at right angles therefrom, said side faces being strengthened by the associated strengthening regions 14, 14', these two end parts form the basic frame.

Figure 2A:
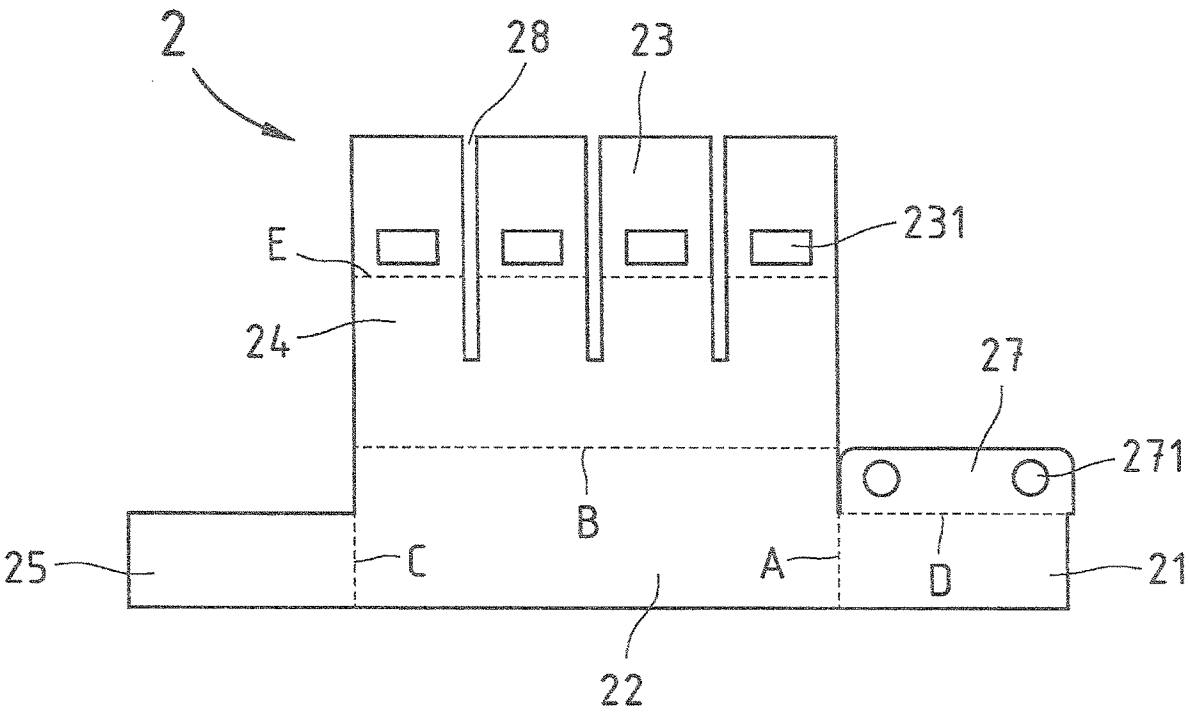
FIGS. 2*a* and 2*b* each show a further sheet metal part in the unbent state.
Figure 2B:
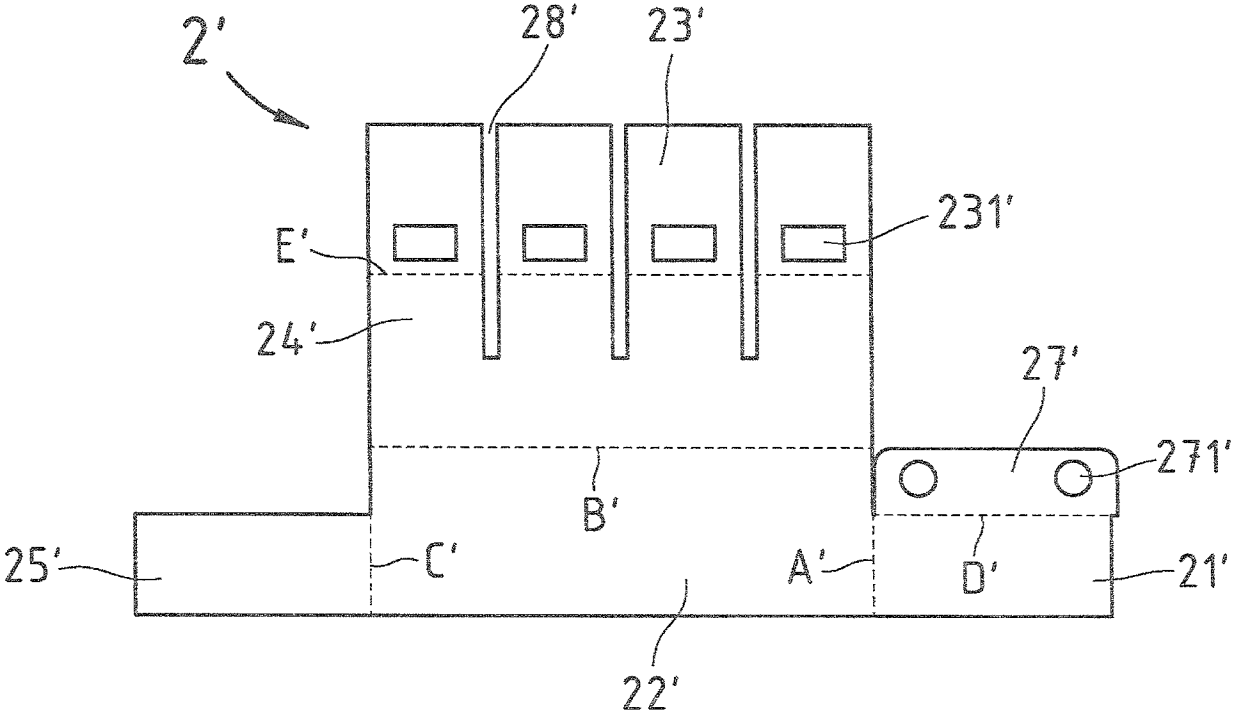

FIGS. 2*a* and 2*b* show two further sheet metal parts 2, 2' in a second embodiment, specifically a third sheet metal part 2 and a fourth sheet metal part 2'. Apart from the size of their windows 231, 231', the two further sheet metal parts 2, 2' can be identical to one another in the present example, which also simplifies the production process for said parts.

These two further sheet metal parts 2, 2' each have the following:

- a side face 22, 22', which is delimited from a first end face 21, 21' by the first bending line A, A' and protrudes beyond the end face 21, 21' in the direction of this first bending line A, A';
- a strengthening region 24, 24', which on the one hand borders the side face 22, 22' at the second bending line B, B' and on the other hand is delimited by the delimitation line E, E';
- a second end face 25, 25' bordering the side face 22, 22' at the third bending line C, C';
- four freely protruding tabs 23, 23', which each have a detent window 231, 231', wherein the tabs 23, 23' are separated from one another by slots 28, 28', wherein the number of tabs 23, 23' and the number of slots 28, 28' corresponding thereto are selected by way of example, and wherein the detent windows 231 in four of the tabs 23 belonging to the third sheet metal part 2 are larger, in particular wider, than the detent windows 231' in the other four tabs 23' belonging to the fourth sheet metal part 2';
- a flange 27, 27' bordering the first end face 21, 21' via a fourth bending line D, D', wherein the flange 27, 27' has screw bores 271, 271'.

At the second bending lines B, B', illustrated by dashed lines, the third and fourth sheet metal parts 2, 2' are folded through 180° in a first direction. Each of the strengthening regions 24, 24' thus comes to lie on one of the side faces 22, 22' respectively, in order to strengthen the side faces 22, 22' accordingly. The dashed line E, E' thus constitutes the limit from which the tabs 23, 23' then protrude beyond the side faces 22, 22'.

The strengthening regions 24, 24' are connected here to the appropriate side faces 22, 22' merely at the common bending lines, specifically at the second bending lines B, B', and accordingly are not fastened thereto in any other way, i.e. are not adhesively bonded, soldered, welded, riveted or the like. The tabs 23, 23' thus have a high flexibility accordingly, since they can be bent over their entire length individually away from the side faces 12, 12', i.e. into the strengthening regions 24, 24'. The length and therefore also the desired resilience of the tabs 23, 23' can thus be set by the length of the slots 28, 28'.

The tabs 23, 23' and the strengthening regions 24, 24' are designated jointly as a cheek region, which for the sake of clarity is not provided with a reference sign. The cheek region is thus divided largely into equal intervals by the six slots 28, 28', whereby the tabs 23, 23' are formed, such that the length of the tabs 23, 23' corresponds to the length of the slots 28, 28'. The term "largely" is to be understood in this context to mean that the slots 28, 28' and therefore also the tabs 23, 23' extend beyond the delimitation lines E, E' into the strengthening regions 24, 24', but preferably end before the second bending lines B, B'. In other words, at least part of the strengthening regions 24, 24' is formed by the tabs 23, 23'. A region of overlap thus exists, which is attributed both to the tabs 23, 23' and to the strengthening regions 24, 24', specifically the region of the tabs 23, 23' lying between the delimitation lines B, E' and the second bending lines B, B'. This region of overlap thus has a dual function, since it serves on the one hand to increase the stability of the basic frame and on the other hand to increase the elasticity of the tabs 24, 24' in respect of outwardly acting forces. This is true in particular when the holding frame is fixedly mounted in a plug connector housing, for example is screwed at its four screw bores 271, 271' into the plug connector housing.

The side faces 22, 22' protrude beyond the first end faces 21, 21' also in the folded state via one of their bending edges corresponding to the second bending line B, B'.

At the first, third and fourth bending lines A, A', C, C', B, D', likewise illustrated in a dashed manner, these two sheet metal parts 2, 2' are bent at right angles. The two sheet metal parts 2, 2' are bent at right angles about the first bending lines A, A' and about the third bending lines C, C' in a second direction, which is opposite the first direction, thus ensuring the U shape of the sheet metal parts 2, 2', which are formed, respectively, from the side faces 22, 22', the first end faces 21, 21', and the second end faces 25, 25'. The cheek region is thus arranged on an outer side, i.e. on a side of the side faces 22, 22' facing away from the bent end faces 21, 25, 21', 25', Due to the right-angled bending at the fourth bending lines D, D', the flanges 27, 27' are formed respectively, these having the screw bores 271, 271' for fastening, for example on or in a plug connector housing (not illustrated in the drawing).

Figure 2C:
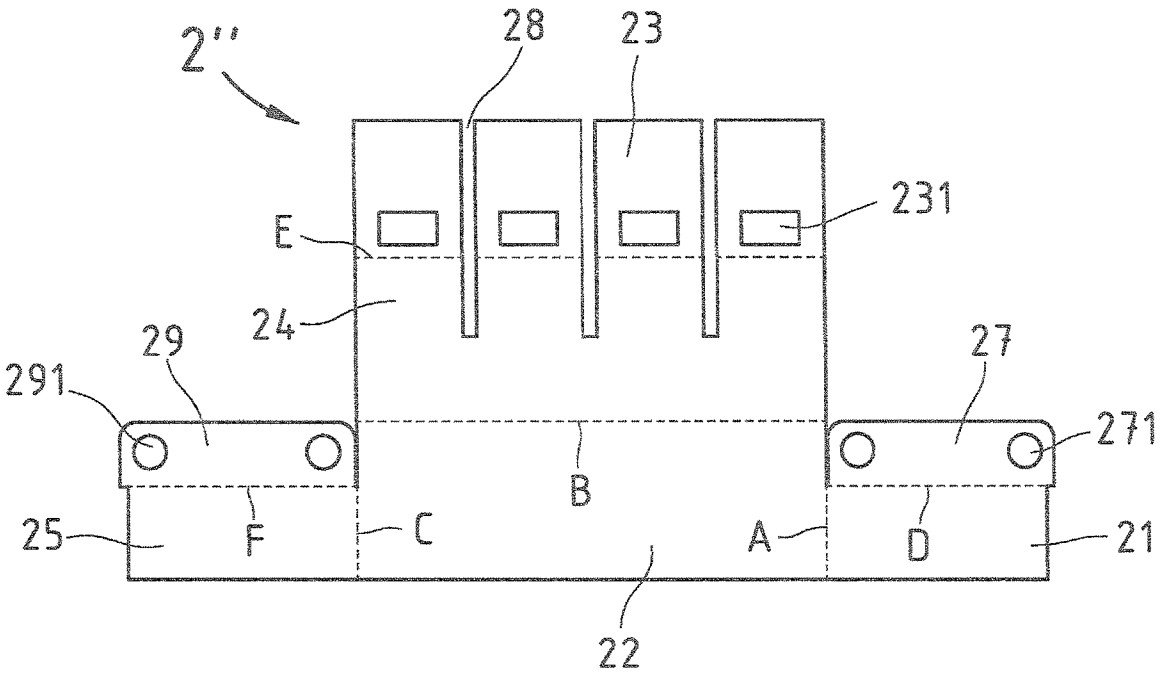
FIGS. 2*c* and 2*d* each show a further sheet metal part having a strengthening flange.
Figure 2D:
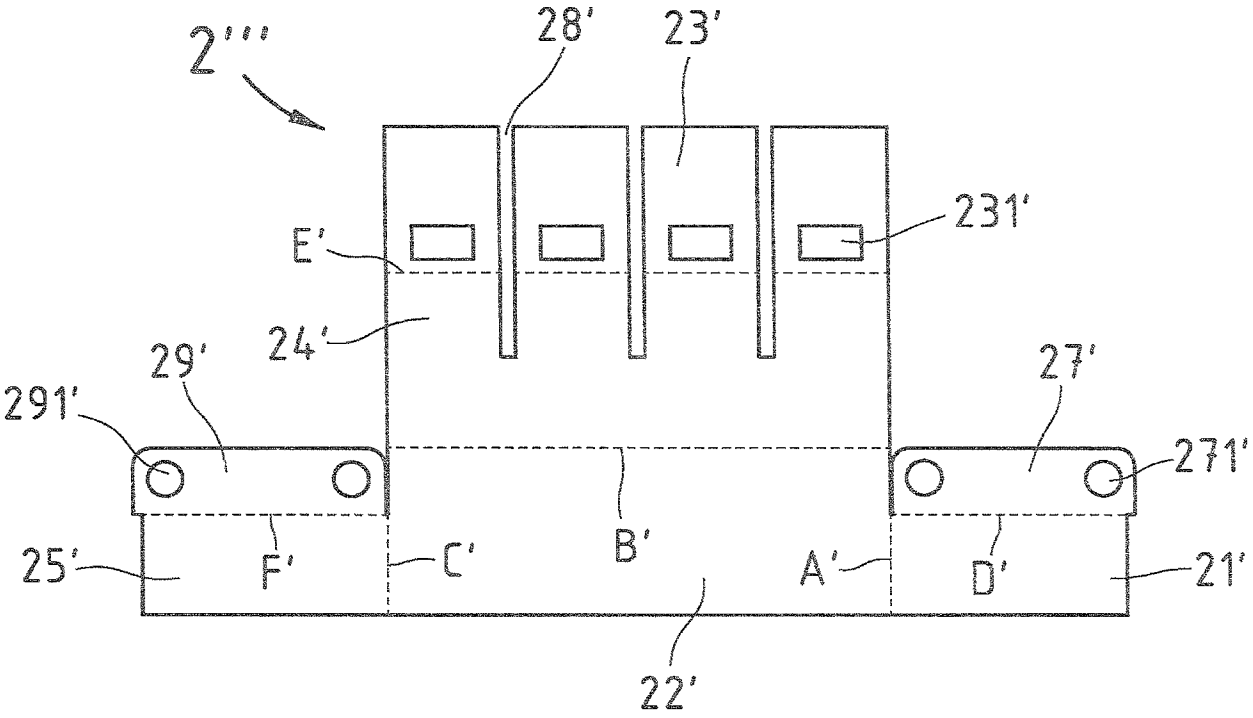

FIGS. 2*c* and 2*d* illustrate two modified sheet metal parts 2", 2'", specifically a fifth sheet metal part 2" and a sixth sheet metal part 2'". These two modified sheet metal parts 2", 2'" differ from the third sheet metal part 2 and from the fourth sheet metal part 2' in that they each have, on their second end face 25, 25' over a further associated fifth bending line F, F', an additional strengthening flange 29, 29' having corresponding screw bores 291, 291'.

Figure 3A:
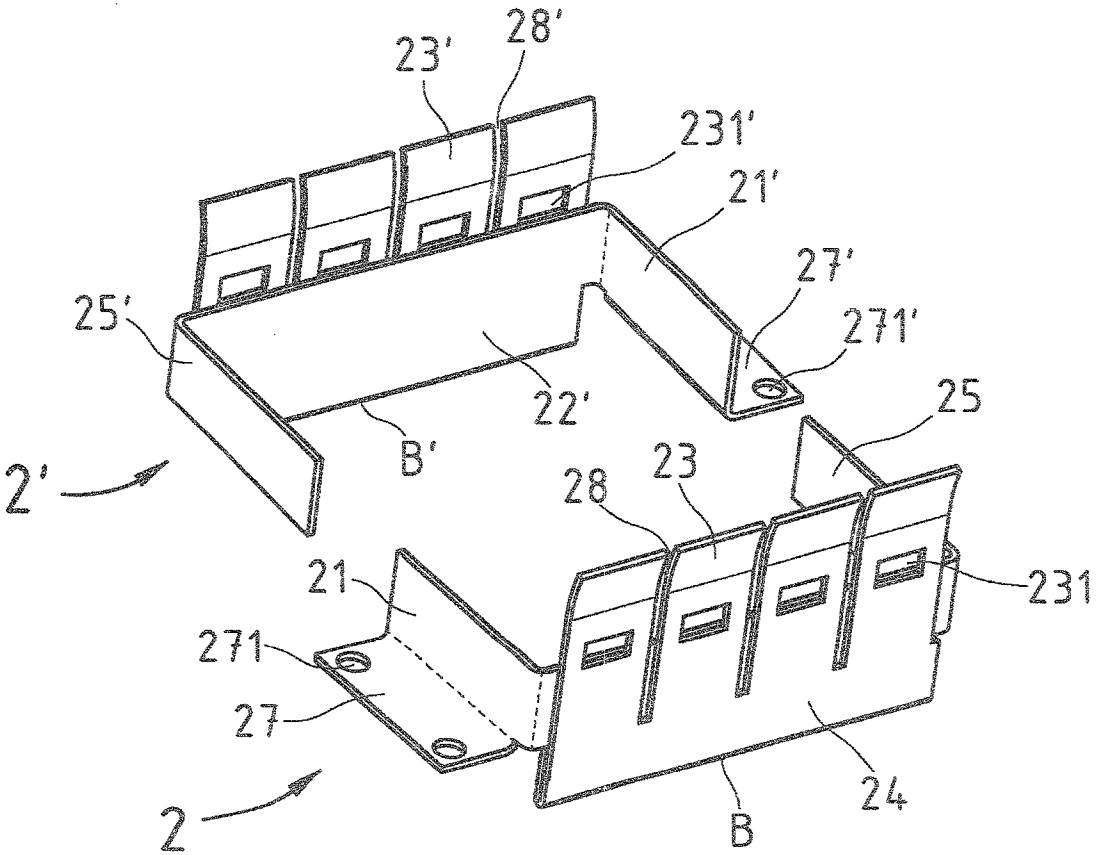
FIG. 3*a* shows the two further sheet metal parts in the bent state when being joined together.
Figure 5:
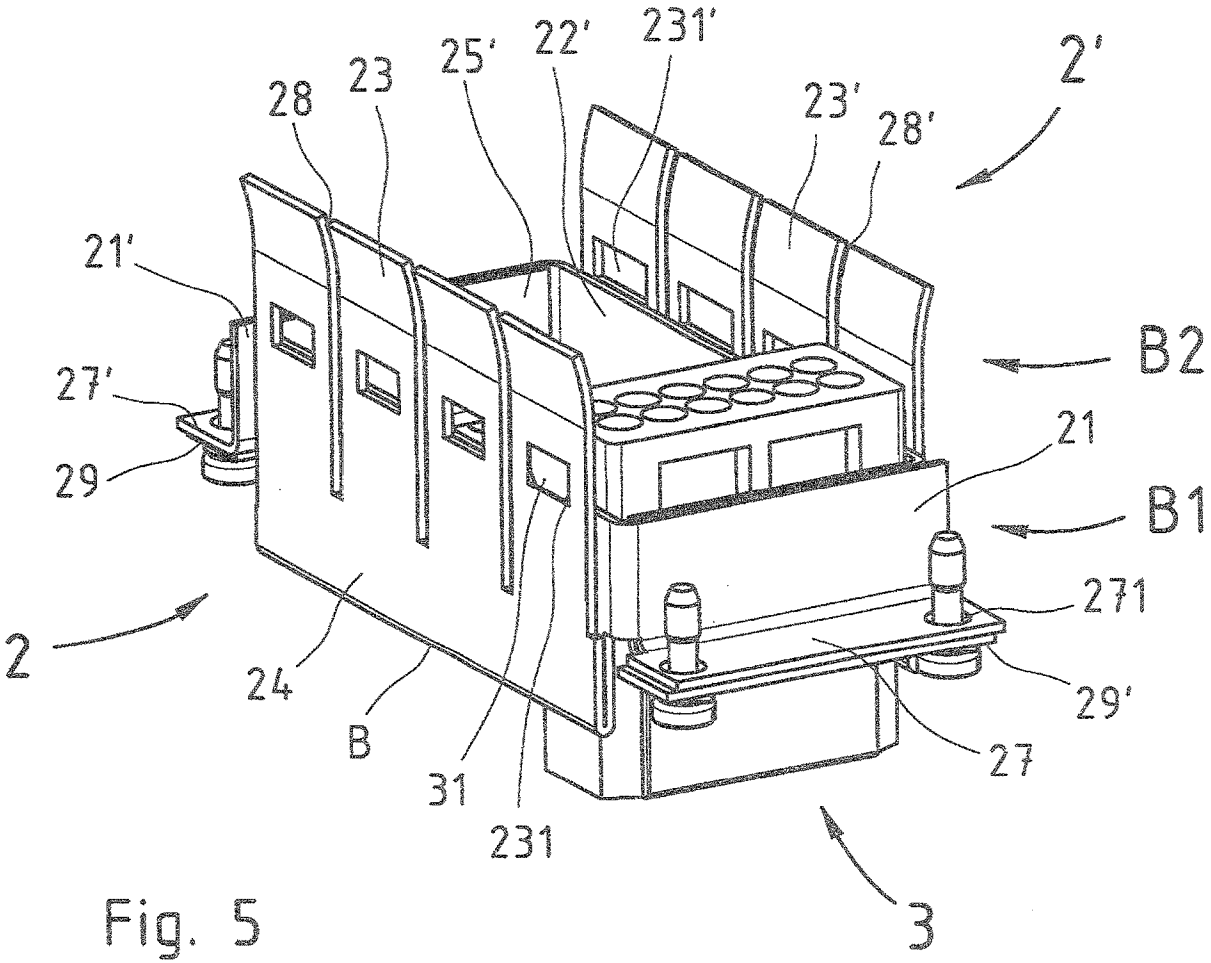
FIG. 5 shows a holding frame loaded with a module.

FIG. 3*a* shows the two further sheet metal parts 2, 2', specifically the third sheet metal part 2 and the fourth sheet metal part 2' in the bent state, whereby they each have the aforementioned U shape and thus can be joined together jointly to form a holding frame, as is illustrated by way of example in FIG. 5, by being offset from one another by a sheet metal thickness and inserted one inside the other such that their first end faces 21, 21' and their second end faces 25', 25 come to lie against one another and can be adhesively bonded, soldered, welded, riveted or screwed or otherwise fastened to one another over a large area.

On the one hand, the holding frame is in this way strengthened in the region of the end faces 21, 21'. The first strengthened end face 21 forms the first end part. The second strengthened end face 21 forms the second end part. On the other hand, a basic frame is thus produced from the two end parts and the two side faces 22, 22' strengthened by the relevant strengthening regions 24, 24', which basic frame is closed over a large area and therefore in a very stable manner by the fastening of the second end faces 25, 25' to the first end faces 21', 21 and also has a particular strength for this reason. This is true in particular when the holding frame is fixedly assembled in a plug connector housing, for example is screwed at its four screw bores 271, 271' into the plug connector housing. The basic frame is also stabilized in the region of its side faces 22, 22', in particular with respect to outwardly acting forces, by the strengthening regions 24, 24'.

In other words, on account of both its closed form and the strengthening of its material at the end and side faces 22, 22', 21, 21', the basic frame thus formed has a particularly high strength, in particular when the holding frame is fixedly mounted in a plug connector housing, for example is screwed at its four screw bores 271, 271' into the plug connector housing. By contrast, the tabs 23, 23' can be bent away over their entire length, which corresponds to the length of the associated slots 28, 28', in an unstrengthened manner from the associated side faces 22, 22' and thus have a particularly high resilience with respect to forces acting outwardly relative to the basic frame. By way of example, in the case of a holding frame of this type installed in particular in the plug connector housing or fixed otherwise at its screw bores 271, 271', a greater force must act at the side face 22' than at the tab 23' in order to push said side face outwardly by a certain distance.

A further embodiment (not illustrated in the drawing) is also conceivable, in which the holding frame consists of more than two parts. By way of example, a part of this type can consist of a flange and a strengthening face, wherein the flange is then bent at right angles from the strengthening face. This strengthening face is then fastened on an end face of the preferably one-part basic frame, for example is glued, soldered, welded, riveted or screwed. A further part may then form the cheek region for example. This further part can then be fastened to a side face of the basic frame. Here, however, care must be taken where possible to ensure that the tabs, in spite of this fastening, can still be bent over their entire length away from the associated side face.

Figure 3B:
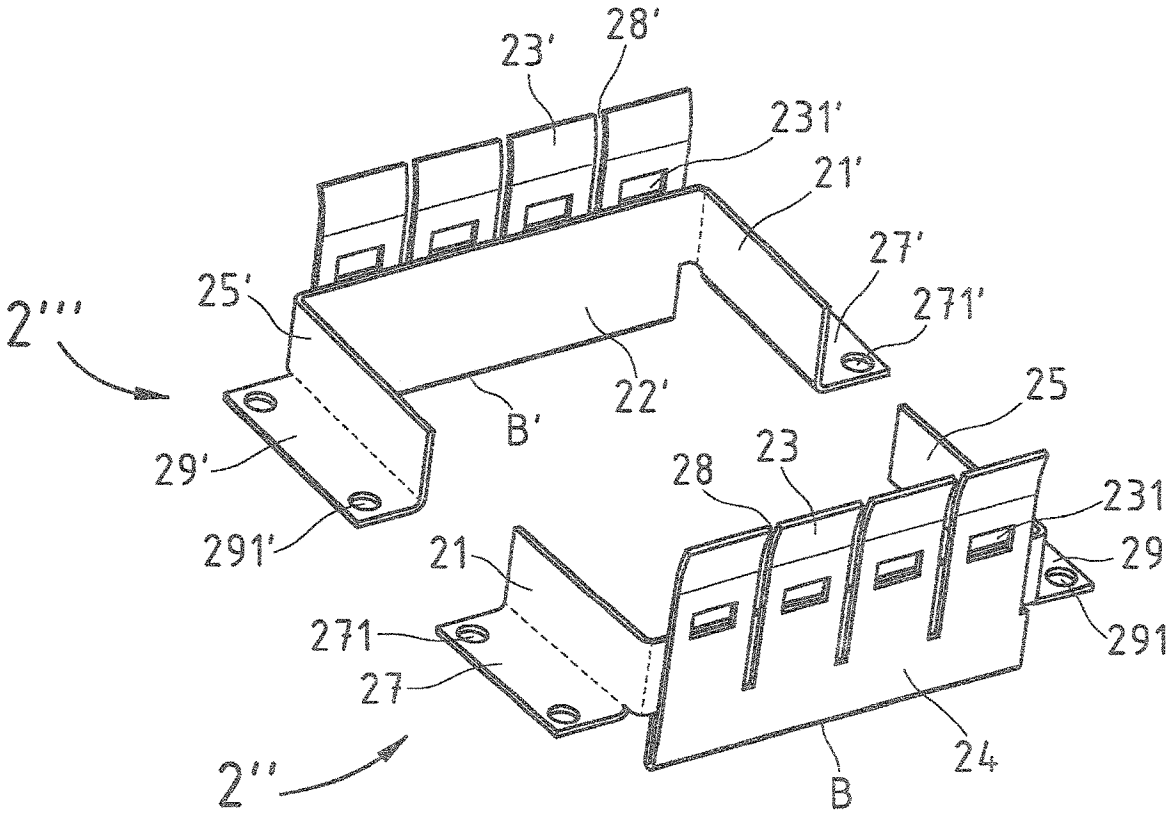
FIG. 3*b* shows the two further sheet metal parts with strengthening flange in the bent state when being joined together.

FIG. 3*b* shows the two modified sheet metal parts 2", 2'", specifically the fifth sheet metal part 2" and the sixth sheet metal part 2'", in each case in a bent state in an illustration comparable to FIG. 3*a*. These two modified sheet metal parts 2", 2'" differ from the bent further modules 2, 2' in that the two modified sheet metal parts 2", 2'" each have on their second end face 25, 25' a strengthening flange 29, 29' bent at right angles, having associated screw bores 291, 291'.

It can be easily seen that when the two bent modified sheet metal parts 2", 2'" are joined together, the flanges 27, 27' and the strengthening flanges 29, 29' come to lie flat on one another, similarly to the first and second end faces 21, 21', 25, 25', and thus can be fastened to one another, for example adhesively bonded, soldered, welded, riveted or screwed.

Figure 4A:
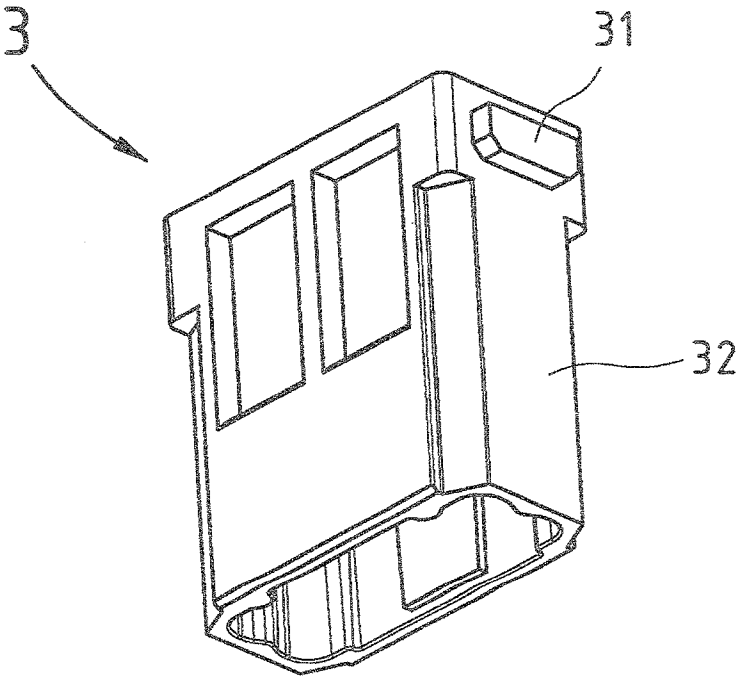
FIGS. 4*a* and 4*b* show an appropriate module from two different views.
Figure 4B:
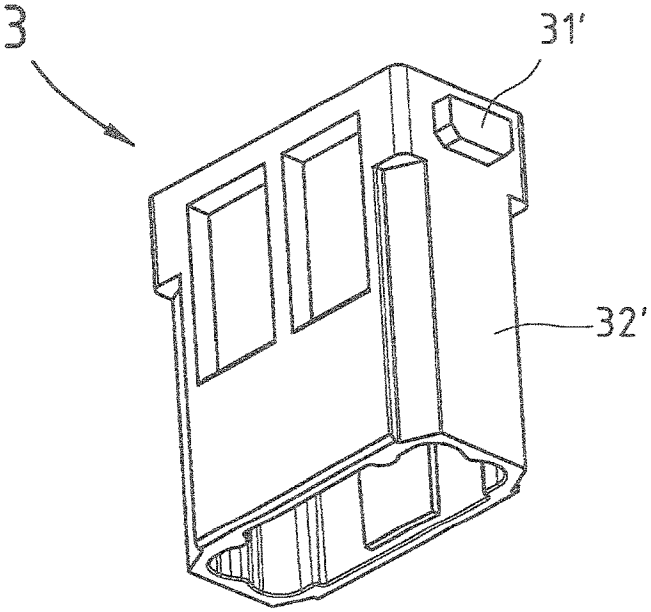

FIGS. 4*a* and 4*b* show a possible design of a module 3, which can be inserted into the holding frame, from two different views, but in each case with a view of the plugging side of said module. Of course, other modules can also be used in similar design.

The module 3 has, on a first longitudinal side 32, a first detent lug 31, which is intended to latch in a first detent window 131, 231, 431. On a second longitudinal side 32' opposite this first longitudinal side 32, the module 3 has a second detent lug 31', which is narrower than the first detent lug. The module is also very compact, which improves the heat resistance thereof. The orientation of the module 3 in the holding frame is determined by the shape of the detent lugs 31, 31' and the shape of the windows 131, 131', 231, 231', 431, 431'.

FIG. 5 shows a holding frame formed from the two further sheet metal parts 2, 2', specifically the third sheet metal part 2 and the fourth sheet metal part 2', as illustrated in FIGS. 2*a*, 2*b* and 3. In another embodiment, said holding frame could also consist of a single first sheet metal part 1, 1' as illustrated in FIGS. 1*a* and 1*b*, or alternatively of a multiplicity of individual parts, i.e. of more than two individual parts.

This holding frame has a first region B1, formed from the basic frame, which is rectangular in cross section, and a second region B2, formed from the two external cheek regions. The first region B1 can be considered to be a basic portion. The second region B2 can be considered to be a deformation portion.

It can be easily seen that the cheek regions, via their strengthening regions 24, 24', strengthen the basic frame with respect to outwardly acting forces, but themselves can be bent away outwardly in an unstrengthened manner. In particular, the tabs 23, 23' inclusive of their region of overlap can be bent away outwardly independently of one another with a relatively low force.

The basic frame installed in a plug connector housing, i.e. fixed at its screw bores 271, 271', can thus advantageously oppose, for example at the middle of its side faces 22, 22', an outwardly directed deflection that is greater than the force necessary to move a tab 23, 23' outwardly over the same distance in the region of the window of said tab.

From the shown perspective only the second side face 22' can be seen, because the first side face 22 is covered by the cheek region comprising the strengthening region 24 and the corresponding tabs 23. By contrast, both end faces 21, 21' can be seen at least in part. The flanges 27, 27' arranged one at each end face 21, 21' and which have the two screw bores 271, 271' are bent. Each of the side faces 22, 22' is thus strengthened by the associated strengthening region 24, 24' by means of the fold that has been performed at the second bending edge B, B'. Part of the strengthening region 24, 24' is thus formed by the region of overlap of the tabs 23, 23'. The side faces 22, 22' and the strengthening regions 24, 24' each protrude beyond the end of the end face 21' via their bending edges corresponding to the second bending lines B, B'.

The first end faces 21, 21' are strengthened by being joined together to the second end faces 25, 25' of the other sheet metal parts 2, 2' respectively, as can also be seen from FIG. 3, and thus form the first and second end parts. Alternatively, in the case of a one-part holding frame, which is thus formed only from a single sheet metal part 1, they can also be formed by folding from a bordering strengthening face 15, 15', as is illustrated by way of example in FIG. 1. A strengthening face could also be joined as a separate component to the end face in an alternative embodiment, wherein the flange would advantageously be bent at right angles from the strengthening face.

The first region B1, specifically the basic frame, thus has a greater strength than the second region B2 for a number of reasons. The first region B1 has this strength on the one hand on account of its closed form, which is realized by the additionally large-area connections of the first and second end faces 21, 25', 21', 25 of the two sheet metal parts 2, 2', and on the other hand on account of the strengthening of this first region B1, which is, implemented at least in part by means of the second region 22, specifically the region of overlap of the tabs 23, 23'. In particular, when distinguishing between the first region B1 and the second region B2, the functionality thereof should thus also be taken into consideration. The basic frame, i.e. the first region B1, is stabilized by the strengthening region and therefore also by a region of overlap of the tabs 23, 23', i.e. also by part of the second region B2, specifically by the strengthening regions 24, 24' thereof. In particular, in accordance with its intended function, specifically the holding of the modules 3, it opposes outwardly acting forces by a particularly high force by means of this strengthening. This is true in particular when the holding frame is fixedly mounted in a plug connector housing, for example is screwed at four screw bores 271, 271' into the plug connector housing, or is otherwise fixed at its screw bores 271, 271'.

The second region B2 consists of the cheek region and comprises the unstrengthened tabs 23, 23' and thus opposes a force acting outwardly onto the tabs 23, 23' relative to the frame by a much lower section modulus than the second region, specifically the basic frame. The second region B2 can thus have a much higher resilience than the first region B1. In other words, the holding frame by way of example has a much greater section modulus with respect to a force acting from the inside towards the second side face 22' of said holding frame than with respect to a force pushing against one of the tabs 23' from the inside. This can be explained in particular in that the section modulus of the side faces 22, 22' and the section modulus of the strengthening regions 24, 24' of the outer cheek region with respect to forces that push against the side faces 22, 22' from the inside are added together to give a total section modulus. This total section modulus is thus of course greater than the section modulus of the individual side faces 22, 22'.

The number of tabs 23, 23', specifically in this case eight, is selected here by way of example; the holding frame could for example also have six, ten, twelve or fourteen or another even number of tabs 23, 23'. The half, specifically in this case the four tabs 23, located on a first side of the holding frame have larger, in particular longer, windows 231 than the other four tabs 23', which are located on the other side of the holding frame and of which the windows 231' are comparatively smaller, in particular narrower, than the first-mentioned windows 231 and accordingly also have a different shape. In particular, the first detent lug 31 of the module 3, as is illustrated by way of example in FIG. 4*a*, can be inserted in an interlocking manner into the larger window 231, and the second detent lug 31', as illustrated by way of example in FIG. 4*b*, can be inserted in an interlocking manner into the smaller window 231'. The orientation of the module 3 in question in the holding frame is fixed as a result of this.

The detent lugs 31, 31' thus either fit in an interlocking manner into the relevant detent windows 231, 231' or at least can be inserted in such a way that the modules 3 can be fixed thereby in the holding frame.

By way of example, a module 3 is illustrated in FIG. 5, with a view of the cable connection side thereof. The module 3 is latched in the holding frame in that the detent lug 31 of said module is received by the detent window 231. Furthermore, it can also be seen that the tabs 23, 23' are slightly bent away from one another at their freely protruding ends, which further facilitates the insertion of a module 3 of this type.

The module 3 is thus held in a particularly stable manner in its position by the particularly fixed and stable first region B1, specifically the basic frame. The module is furthermore stabilized in that the basic frame, in the region of its side faces 22, 22', protrudes via its bending edge B beyond the end of the end faces 21, 21' and thus in particular provides a strong lever effect. The holding frame thus holds the modules 3 at the longitudinal sides 32, 32' thereof over a large area.

The module 3 furthermore is latched in the tabs 23, 23' with very easy handling, wherein the tabs, on account of their resilience, can be easily bent away from one another with only little force, both for latching and for unlatching. In particular, the tabs 23, 23' that latch a module can be bent individually away from one another in order to unlatch again and thus release again the individual module independently of other modules.

Since the tabs 23, 23' of the holding frame are bent away slightly from the holding frame at their freely protruding end region, the modules 3 can be inserted into the holding frame in a particularly comfortable manner. For this purpose, a module 3 is initially inserted between two tabs 231, 231' of the holding frame and then slides via its two longitudinal sides 32, 32' and in particular via the detent lugs 31, 31' molded integrally thereon along the end regions of the tabs 231, 231' bent away from one another. The two tabs 231, 231' are thus bent temporarily away from one another, until the relevant detent lugs 31, 31' are received by the appropriate detent windows 231, 231' of the tabs 23, 23' and thus latch therein. As the detent lugs 31, 31' are received in the relevant detent windows 231, 231', the tabs 23, 23' spring back preferably into their starting position. In this way the modules 3 can be individually latched in or also removed from the holding frame. At the same time, the module 3 in question is held with a strong force in the holding frame, in particular by the stable and fixed first region B1, specifically the strengthened basic frame. A very good ratio between holding force and actuation force is thus achieved.

LIST OF REFERENCE SIGNS

1 first sheet metal part
1' second sheet metal part

2 third sheet metal part
2' fourth sheet metal part
2" fifth sheet metal part
2'" sixth sheet metal part
11, 11' end faces
21, 21' first end faces
25, 25' second end faces
12, 12', 22, 22'-side faces
13, 13', 23, 23' tabs
131, 131', 231, 231' detent windows
14, 14', 24, 24' strengthening region
15, 15', 45' strengthening faces
17, 17', 27, 27' flange
29, 29' strengthening flange
171, 171', 271, 271' screw bores
18, 18', 28, 28' slots
3 module
31, 31' first, second detent lug
32, 32' first, second longitudinal side
A,A', B,B', C,C',C",
C'",D,D', F,F' bending lines
E, E' delimitation line

The invention claimed is:

1. A holding frame for a plug connector for receiving modules of the same type and/or different modules, wherein the holding frame is formed entirely from a metal sheet, said holding frame being rectangular in cross-section, and having four walls each having a strengthened edge forming a flange region, receiving a module in a plane, each said strengthened flange region being formed of a doubled-over layer of said metal sheet, folded upon itself through 180°, said holding frame also comprising a resiliently deformable region formed integrally with and as an extension of one layer of the folded over layer of the metal sheet forming said flange region, which can assume an insertion state and a holding state, wherein the insertion state allows at least one module to be inserted into the holding frame in a direction transverse to the plane and in the holding state a received module is fixed.

2. The holding frame as claimed in claim 1, wherein the strengthened flange region and the resiliently deformable region are formed from a single sheet metal part.

3. The holding frame as claimed in claim 1, wherein the strengthened flange region has a first end part, a second end part, a first side part, and a second side part, wherein the first side part is arranged between the first end part and the second end part, and the second end part is arranged between the first side part and the second side part, wherein the resiliently deformable region has a first cheek region and a second cheek region, wherein the first cheek region adjoins the first side part and the second cheek region adjoins the second side part.

4. The holding frame as claimed in claim 1, wherein the strengthened flange region and/or the resiliently deformable region are formed in a number of parts and at least part of the strengthened flange region is formed integrally with at least part of the resiliently deformable region.

5. The holding frame as claimed in claim 4, wherein the strengthened flange region and the resiliently deformable region are each formed in two parts, wherein a first part of the strengthened flange region has a first end part and a first side part at the first end part, and a second part of the strengthened flange region has a second end part and a second side part at the second end part, wherein a first part of the resiliently deformable region has a first cheek region and a second part of the resiliently deformable region has a second cheek region, wherein the first cheek region adjoins the first side part and the second cheek region adjoins the second side part.

6. The holding frame as claimed in claim 4, wherein the strengthened flange region and the resiliently deformable region are each formed in two parts, wherein a first part of the strengthened flange region has a first end part and a second end part and a first side part between the end parts, and a second part of the basic portion has a second side part, wherein a first part of the resiliently deformable region has a first cheek region and a second part of the resiliently deformable region has a second cheek region, wherein the first cheek region adjoins the first side part and the second cheek region adjoins the second side part.

7. The holding frame as claimed in claim 4, wherein the strengthened flange region and the resiliently deformable region are each formed in two parts, wherein a first part of the strengthened flange region has a first side part and a second side part and a first end part between the side parts, and a second part of the strengthened flange region has a second end part, wherein a first part of the resiliently deformable region has a first cheek region and a second part of the resiliently deformable region has a second cheek region, wherein the first cheek region adjoins the first side part and the second cheek region adjoins the second side part.

8. The holding frame as claimed in claim 1, wherein the strengthened flange region is formed at least in part in two or more layers of sheet metal.

9. The holding frame as claimed in claim 1, wherein the resiliently deformable region is designed for an elastic deformation between an insertion state and a holding state or a plastic deformation from the insertion state to the holding state.

10. The holding frame as claimed in claim 1, wherein the resiliently deformable region has a plurality of tabs, wherein at least two of said plurality of tabs are separated from one another by a slot.

11. The holding frame as claimed in claim 10, wherein the at least one slot extends into the basic portion.

12. The holding frame as claimed in claim 1, wherein the resiliently deformable region has one or more detent windows to receive a detent lug of a module and/or one or more detent protrusions to be received in a detent recess of a module.

13. A method for producing a holding frame for a plug connector for receiving modules of the same type and/or different modules, wherein the holding frame has a plurality of different regions which have different elasticity from each other, wherein said holding frame is formed entirely from a metal sheet, said holding frame being rectangular in cross-section and having four walls each having a strengthened edge forming a flange region for receiving a module in a plane, said strengthened flange region being formed of a doubled-over layer of said metal sheet, by folding the metal sheet upon itself through 180°, said holding frame also comprising a resiliently deformable region formed integrally with and as an extension of one layer of the folded over layer of the metal sheet of the said strengthened flange region, which can assume an insertion state and a holding state, wherein the insertion state allows at least one module to be inserted into the strengthened flange region into the holding frame in a direction transverse to the plane and in the holding state a received module is fixed.

14. A method for inserting a module into a holding frame for a plug connector for receiving modules of the same type and/or different modules, wherein the holding frame is formed entirely from a metal sheet, said holding frame being rectangular in cross-section and having four walls each having a strengthened edge forming a flange region for receiving a module into the strengthened flange region of the holding frame in order to fix the module in a plane, said strengthened flange region being formed of a doubled-over layer of said metal sheet, folded upon itself through 180°, said holding frame also comprising fixing of the module in the basic portion by deformation of a resiliently deformable region of the holding frame formed integrally with one layer of the folded over layer of the metal sheet of said strengthened flange region.

15. A method for inserting a module into a holding frame for a plug connector for receiving modules of the same type and/or different modules, wherein the holding frame is formed entirely from a metal sheet, said holding frame being rectangular in cross-section and having four walls each having a strengthened edge forming a flange region for receiving a module into the strengthened flange region of the holding frame for fixing the module in a plane, said strengthened flange region being formed of a doubled-over layer of said metal sheet, folded upon itself through 180°, said holding frame also comprising fixing of the module in the basic portion by resiliently deforming the resiliently deformable region of the holding frame formed integrally with one layer of the folded over layer of said strengthened flange region, wherein the module is inserted into the holding frame from the direction of the cable connection.

16. A metal holding frame for a plug connector for receiving modules of the same type and/or different modules wherein the holding frame is formed entirely in one piece from a metal sheet, wherein the frame is rectangular in cross-section and has four walls each having a strengthened edge forming a flange region for receiving a module, wherein the strengthened flange region, is formed by bending the metal sheet on itself at least at one bending line through 180° to form a double layer.

17. The metal holding frame as claimed in claim 16, wherein the holding frame comprises two resilient sheet metal parts.

18. The metal holding frame as claimed in claim 16, wherein the holding frame comprises more than two resilient sheet metal parts.

19. The metal holding frame as claimed in claim 16, wherein at least one of the metal sheet parts has at least one bending line at which it is bent.

20. The metal holding frame as claimed in claim 19, wherein the at least one metal sheet part is bent at right angles at least at one bending line.

21. The metal holding frame as claimed in claim 17, wherein a plurality of metal sheet parts are arranged flat on one another at least in regions.

22. The metal holding frame as claimed in claim 21, wherein said plurality of metal sheet parts are fastened to one another by adhesive bonding, welding, soldering, riveting and/or screwing.

23. The metal holding frame as claimed in claim 16, wherein the holding frame has at least the following:

two end faces;

two side parts;

two cheek regions, wherein each cheek region has an integral strengthened flange region and a plurality of tabs.

24. The metal holding frame as claimed in claim 23, wherein each tab has a detent window, which is adapted to receive a detent lug of a module, wherein at least some of the detent windows are of different size and shape to receive detent lugs of different size and shape.

25. The metal holding frame as claimed in claim 23, wherein the holding frame has a basic frame, consisting of the two side parts and the two end faces.

26. The metal holding frame as claimed in claim 23, wherein each end face is bent at right angles from at least one side part, and in that each cheek region is folded over a side part, such that the strengthened flange region is arranged on the side part, wherein the tabs protrude beyond the side part.

27. The metal holding frame as claimed in claim 23, wherein the holding frame comprises two sheet metal parts, and in that each of the two sheet metal parts has a first end face and a second end face, which are both angled at right angles from their associated side part.

28. The metal holding frame as claimed in claim 27, wherein the first end faces and the second end faces of the two sheet metal parts are fastened to one another respectively.

29. The metal holding frame as claimed in claim 16, wherein the metal sheet part or the metal sheet parts is/are (a) punched and bent part(s).

30. The metal holding frame as claimed in claim 16, wherein the holding frame has an electrical protective earthing contact.

31. A method for producing a metal holding frame for a plug connector, wherein the holding frame is adapted to receive modules of the same type and/or different modules, wherein the holding frame is rectangular in cross-section and has four walls each having a strengthened edge forming a flange region for receiving a module, said holding frame being formed entirely in one piece from a metal sheet, by folding the metal sheet along at least one bending line through 180° to form a doubled-over layer strengthened flange region having a common adjacent edge.

32. The method as claimed in claim 31, wherein the holding frame is formed either in one piece from a single metal sheet part by folding or from a plurality of sheet metal parts by folding and joining.

33. The method as claimed in claim 32, wherein the metal sheet part or the metal sheet parts is/are shaped in a first region of the holding frame to produce a basic frame, which is substantially rectangular in cross section and which has at least two end faces and two side parts.

34. The method as claimed in claim 33, wherein the metal sheet part or the metal sheet parts has/have a second region in the form of two cheek regions, which are folded over an adjacent side part and thus strengthen the basic frame at the side part.

35. The method as claimed in claim 34, wherein the holding frame with its basic frame holds a module received therein in a direction and at the same time fixes this module perpendicularly thereto using tabs belonging to an adjacent cheek region.

36. The method as claimed in claim 35, wherein the holding frame fixes the module via the tabs thereof by latching the module at the tabs.

* * * * *